US007703296B2

(12) United States Patent
Jang et al.

(10) Patent No.: US 7,703,296 B2
(45) **Date of Patent: *Apr. 27, 2010**

(54) DUAL COOLING MODE AIR CONDITIONER FOR NORMAL OR RAPID COOLING

(75) Inventors: Ji Young Jang, Sungnam-si (KR); Chan Ho Song, Koyang-si (KR); Jae Hoon Sim, Seoul (KR); Se Yoon Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 1017 days.

This patent is subject to a terminal disclaimer.

(21) Appl. No.: 11/373,270

(22) Filed: Mar. 13, 2006

(65) Prior Publication Data

US 2007/0251248 A1 Nov. 1, 2007

(30) Foreign Application Priority Data

Jun. 9, 2005 (KR) ..... 10-2005-0049318

(51) Int. Cl.
*F25B 7/00* (2006.01)

(52) U.S. Cl. ..... 62/335; 62/79; 62/513

(58) Field of Classification Search ..... 62/335, 62/79, 467, 510, 519, 524, 527
See application file for complete search history.

(56) References Cited

U.S. PATENT DOCUMENTS

| | | | | |
|---|---|---|---|---|
| 4,149,389 | A * | 4/1979 | Hayes et al. | 62/79 |
| 4,391,104 | A * | 7/1983 | Wendschlag | 62/79 |
| 4,788,829 | A | 12/1988 | Takemasa et al. | |
| 5,447,038 | A * | 9/1995 | Vaynberg | 62/175 |
| 5,625,526 | A * | 4/1997 | Watanabe et al. | 361/234 |
| 5,964,098 | A * | 10/1999 | Huang et al. | 62/279 |
| 6,807,815 | B2 | 10/2004 | Lee et al. | |
| 6,807,816 | B2 | 10/2004 | Lee et al. | |
| 6,843,067 | B2 | 1/2005 | Lee et al. | |
| 6,883,348 | B2 | 4/2005 | Hong et al. | |

FOREIGN PATENT DOCUMENTS

| | | |
|---|---|---|
| CN | 1023833 | 2/1994 |
| EP | 1072453 | 1/2001 |

* cited by examiner

*Primary Examiner*—Cheryl J Tyler
*Assistant Examiner*—Justin Loffredo
(74) *Attorney, Agent, or Firm*—Birch, Stewart, Kolasch & Birch, LLP

(57) ABSTRACT

Disclosed is an air conditioner that can operate in a general cooling mode in which indoor air is cooled by heat exchange with a first refrigerant in a main evaporator, or alternatively in a fast cooling mode in which the indoor air is primarily cooled by heat exchange in a midway heat exchanger which includes the main evaporator for the first refrigerant and a fast cooling condenser for a second refrigerant, and then re-cooled in a fast cooling evaporator for the second refrigerant. Accordingly, fast and agreeable air cooling can be achieved.

7 Claims, 6 Drawing Sheets

DUAL COOLING MODE AIR CONDITIONER FOR NORMAL OR RAPID COOLING

BACKGROUND OF THE INVENTION

1. Field of the Invention

The present invention relates to an air conditioner. More particularly, the present invention relates to an air conditioner in which air is cooled once by a first step of heat exchange with a first refrigerant, and then is re-cooled by a second step of heat exchange with a second refrigerant.

2. Description of the Related Art

Generally, an air conditioner cools or heats a room, cleans air and removes moisture in the air to create more comfortable and agreeable indoor environment.

Among the above described functions of the air conditioner, air-cooling is performed by the following cooling cycle in which heat exchange is caused between indoor air and a refrigerant.

FIG. 1 illustrates a diagram of a cooling cycle of an air conditioner according to a related art.

As shown in FIG. 1, the air cooling cycling includes a compressor 2 in which a vaporized refrigerant is turned into a compressed air with high pressure, a condenser 4 in which the compressed refrigerant is condensed and its temperature becomes low as the refrigerant performs heat exchange with air, an expansion value 6 in which the condensed refrigerant is expanded and its pressure becomes low, and an evaporator 8 in which the low temperature and low pressure liquid refrigerant is vaporized by performing heat exchange with air.

The compressor 2 is classified into a single type having one compressor and a multi-type having at least two compressors. The single type compressor 2 is classified into an inverter type in which compression capacity varies according to load and a constant speed type in which compression capacity is constant. In the multi-type compressor 2, at least two compressors alternatively operate according to the load.

According to the cooling cycle of the related art air conditioner, indoor air is cooled by heat of vaporization of a refrigerant in the evaporator 8, and the refrigerant vaporized in the evaporator 8 is recovered to the low temperature and low pressure liquid refrigerant while it sequentially passes through the compressor 2, the condenser 4 and the expansion valve 6.

The air conditioner according to the related art has a problem as follows:

That is, in the case in which there is a big different between an indoor air temperature and a target temperature, such case being encountered at an initial operation stage of the air conditioner or when hot outdoor air is blown into the interior of a room, the air conditioner can not refrigerate air at once because the cooling capacity is not increased rapidly.

SUMMARY OF THE INVENTION

Accordingly, the present invention is provided to solve the above described disadvantages and problems. An aspect of the present invention is to provide an air conditioner capable of rapidly cooling air, thereby to provide agreeable air to a user immediately even load is high.

In order to achieve the objects above, according to an aspect of the present invention, there is provided an air conditioner comprising a main compressor in which a first refrigerant is compressed; a main condenser in which the compressed first refrigerant is condensed; a main expansion valve in which the condensed first refrigerant is expanded; a main evaporator in which the first refrigerant discharged from the main expansion valve performs heat exchange with ambient air and evaporates, thereby cooling the ambient air; and a fast cooling means including a fast cooling cycle for re-re-cooling the ambient air cooled by the main evaporator, using a second refrigerant which is condensed by performing heat exchange with the first refrigerant of the main evaporator.

The fast cooling means includes a fast cooling condenser in which the second refrigerant is condensed by performing heat exchange with the first refrigerant of the main evaporator; a fast cooling expansion valve in the second refrigerant condensed in the fast cooling condenser is expanded; a fast cooling evaporator in which the second refrigerant discharged from the fast cooling expansion valve evaporates by performing heat exchange with the air cooled in the main evaporator; and a fast cooling compressor in which the second refrigerant having evaporated in the fast cooling evaporator is compressed.

The air conditioner further includes a controller which controls the whole air conditioner such that air is cooled by a cooling cycle of the first refrigerant in a general cooling mode, or alternatively is cooled fast by cooling cycles of the first and second refrigerants in a fast cooling mode.

The second refrigerant is a material having a lower evaporation calorie than the first refrigerant so that the first refrigerant can be condensed by heat exchange with the first refrigerant.

The he first refrigerant is R-22 and the second cooling is R-23.

According to another aspect of the present invention, there is provided an air conditioner comprising: a main compressor in which a first refrigerant is compressed; a main condenser in which the first refrigerant compressed in the main compressor is condensed; a main expansion valve in which the first refrigerant condensed in the main condenser is expanded; a main evaporator in which the first refrigerant discharged from the main expansion valve evaporates by performing heat exchange with ambient air, thereby cooling the ambient air; and a fast cooling means having a cooling cycle for re-cooling the ambient air cooled once in the main evaporator, using a second refrigerant condensed by heat exchange with the first refrigerant of the main evaporator, wherein the fast cooling means includes: a fast cooling condenser in which the second refrigerant is condensed by performing heat exchange with the first refrigerant of the main evaporator; a fast cooling re-condenser in which the second refrigerant condensed in the fast cooling condenser is re-condensed by performing heat exchange with ambient air; a fast cooling expansion valve in which the re-condensed second refrigerant is expanded; a fast cooling evaporator in which the second refrigerant discharged from the fast cooling expansion valve evaporates by performing heat exchange with the ambient air cooled in the main evaporator; and a fast cooling compressor in which the second refrigerant having evaporated in the fast cooling evaporator is compressed.

The fast cooling re-condenser includes a sink refrigerant pipe through which the second refrigerant flows, and a sink blower for generating a blowing force such that the second refrigerant in the sink refrigerant pipe is condensed by heat exchange with ambient air.

The air conditioner further includes a controller which controls the whole air conditioner such that air is cooled by a cooling cycle of the first refrigerant in a general cooling mode, or alternatively cooled fast by cooling cycles of the first and second refrigerants in a fast cooling mode.

The second refrigerant comprises a material having a lower evaporation calorie than the first refrigerant such that the second refrigerant is condensed by performing heat exchange with the first refrigerant.

The first refrigerant is R-22 and the second refrigerant is R-23.

The air conditioner further includes an indoor blower for generating a blowing force that enables air cooled in the main evaporator sequentially to pass through the fast cooling evaporator, thereby performing heat exchange.

The air conditioner according to the embodiment of the present invention is advantageous in that fast and agreeable cooling can be achieved by simultaneously operating the general cooling cycle using the first refrigerant and the fast cooling cycle using second refrigerant, in which the indoor air cooled by the general cooling cycle is re-cooled by the fast cooling cycle.

The air conditioner according to the embodiment of the present invention is advantageous in that it is possible to respond to user's demand and indoor load, and enhance energy efficiency by alternatively operating only the first cooling cycle in the general cooling mode or both of the first and second cooling cycles simultaneously in the fast cooling mode.

The air conditioner according to the embodiment of the present invention is advantageous in that it is possible to ensure undercooling by adopting the double cooling cycle using R-22 as the first refrigerant and R-23 as the second refrigerant so that the first refrigerant of the main evaporator and the second refrigerant of the fast cooling condenser can perform heat exchange with each other in the fast cooling mode.

BRIEF DESCRIPTION OF THE DRAWINGS

The above and/or other aspects and advantages of the prevent invention will become apparent and more readily appreciated from the following description of the exemplary embodiments, taken in conjunction with the accompany drawings, in which.

DETAILED DESCRIPTION OF THE INVENTION

Figure 1:
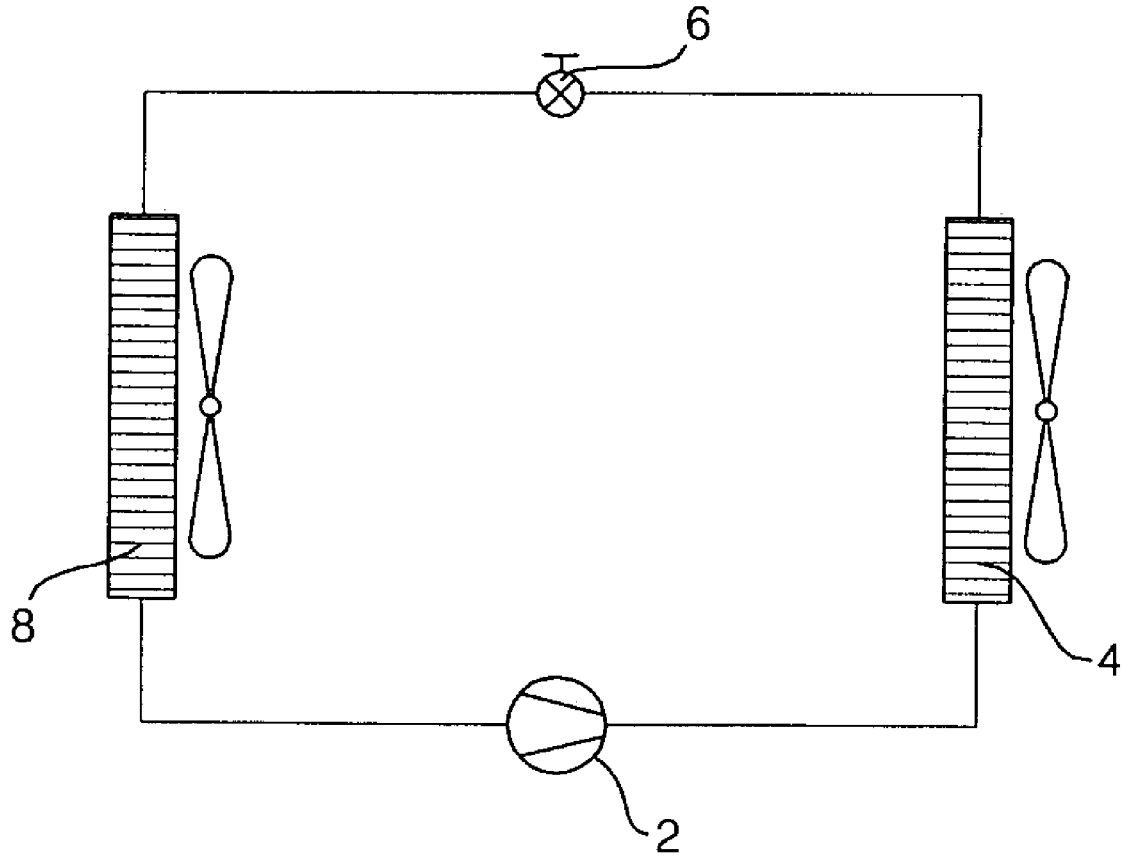
Fig. 1 (related art)
FIG. 1 is a block diagram illustrating an air conditioning cycle according to a related art.

Reference will now be made in detail to the embodiments of the present invention, examples of which are illustrated in the accompanying drawings, wherein like reference numerals refer to like elements throughout. The embodiments are described below so as to explain the present invention by referring to the figures.

Figure 2:
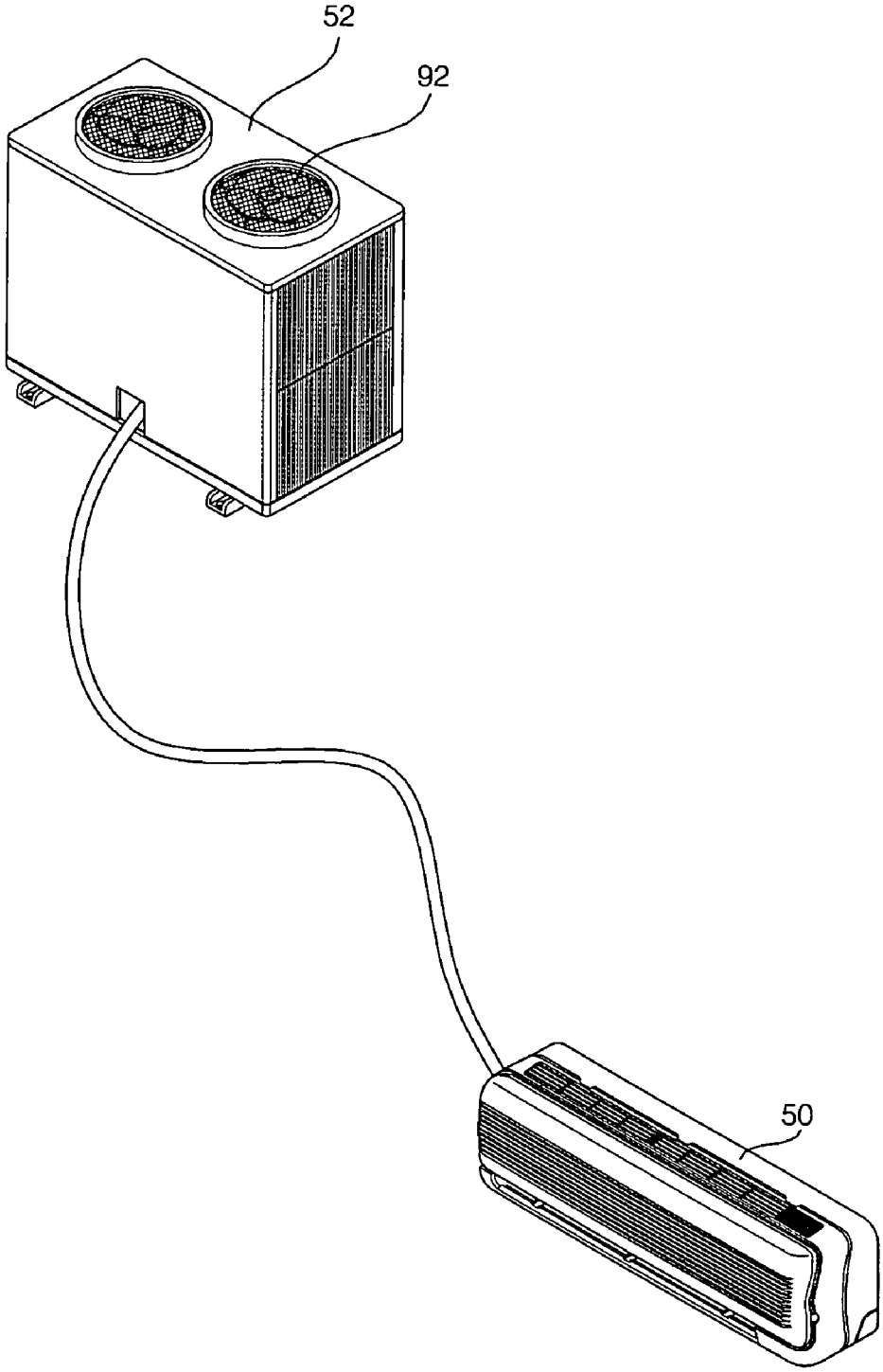
FIG. 2 is a perspective view illustrating an air conditioner according an embodiment of the present invention.
Figure 3:
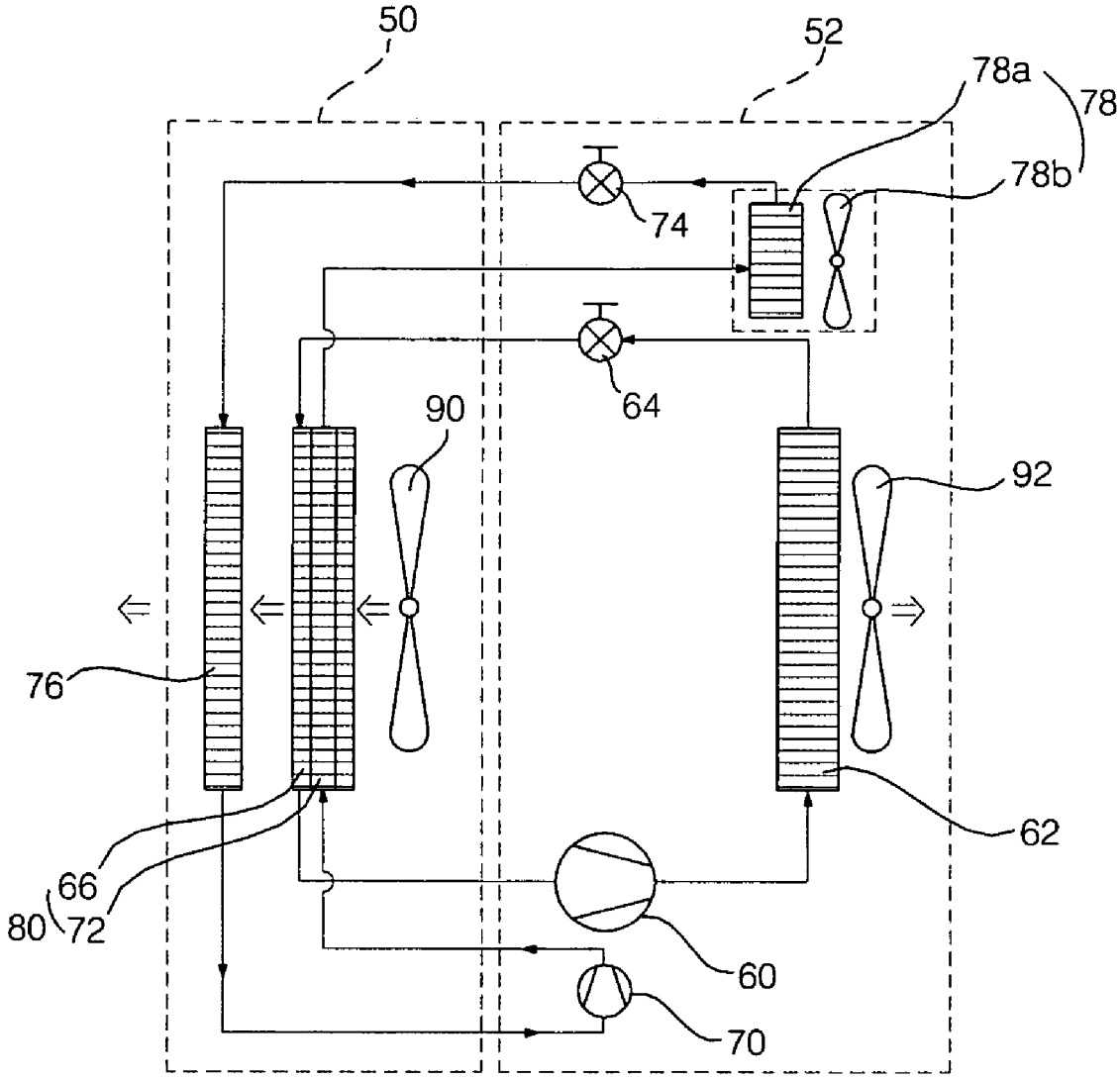
FIG. 3 is a block diagram illustrating an air conditioning cycle according to an embodiment of the present invention.
Figure 4:
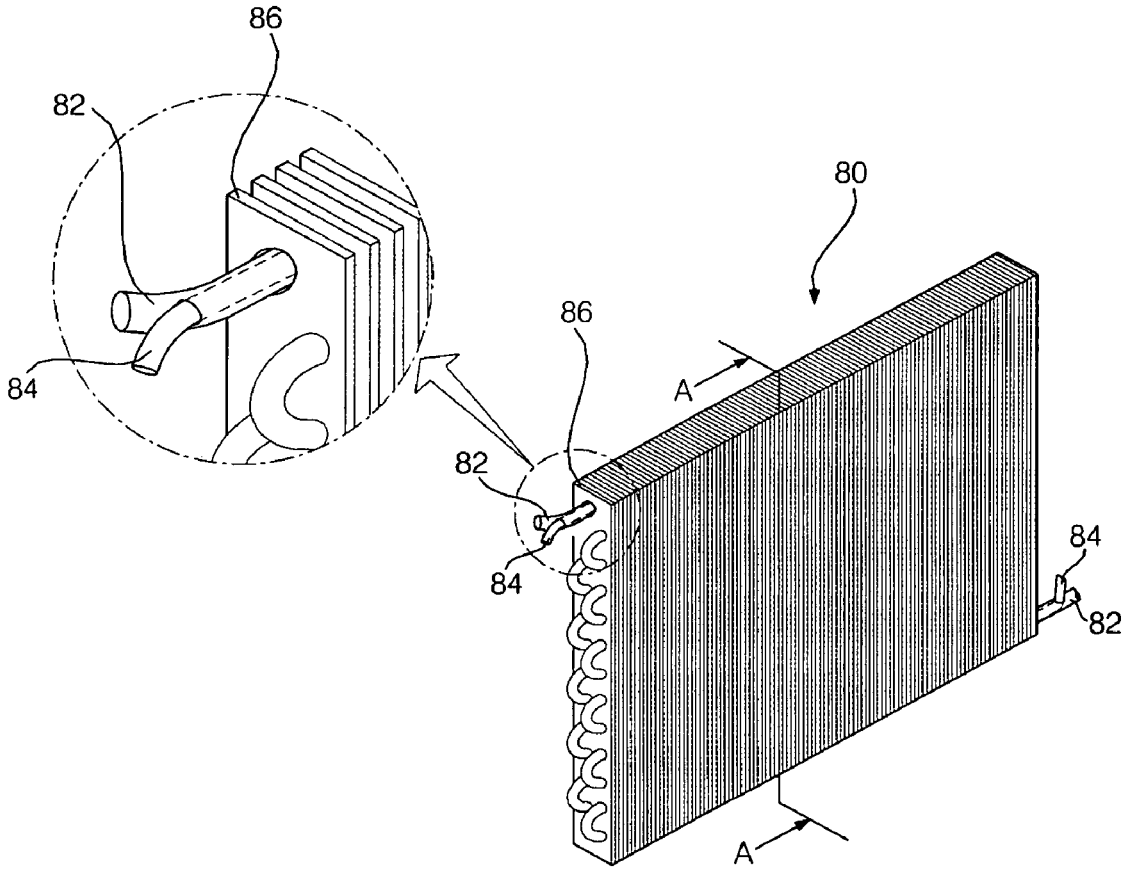
FIG. 4 is a perspective view illustrating a midway heat exchanger of the air conditioner according to the embodiment of the present invention.
Figure 5:
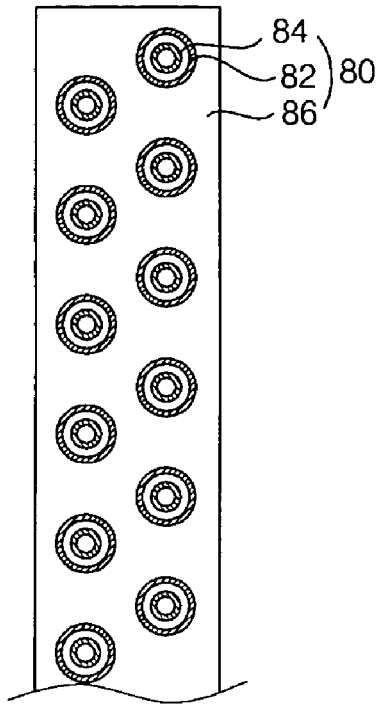
FIG. 5 is a sectional view taken along a line A-A' in FIG. 4.
Figure 6:
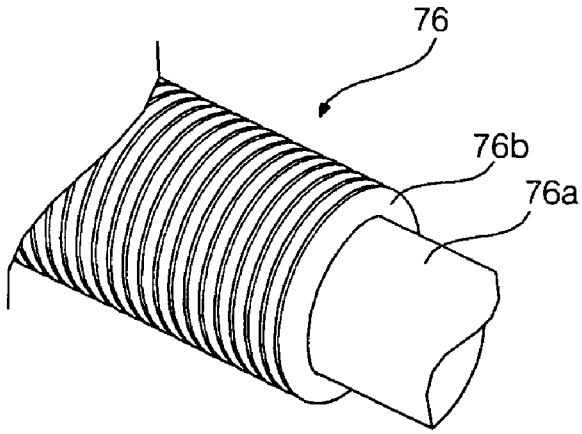
FIG. 6 is a perspective view partially illustrating a fast-cooling evaporator of the air conditioner according to the embodiment of the present invention.
Figure 7:
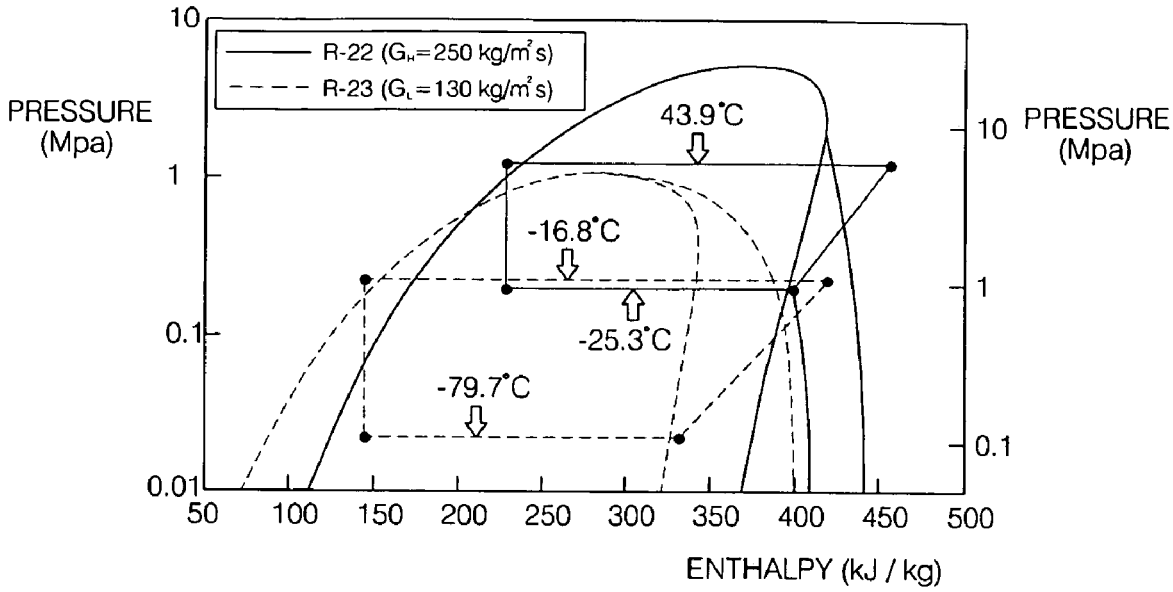
FIG. 7 is a graph illustrating air conditioning cycles according to the present invention.

FIG. 2 illustrates a perspective view of an air conditioner according to an embodiment of the present invention, FIG. 3 illustrates a block diagram of an air conditioning cycle, FIG. 4 illustrates a perspective view of a midway heat exchanger of the air conditioner, FIG. 5 illustrates a sectional view taken along a line A-A in FIG. 4, FIG. 6 illustrates a perspective of a fast-cooling evaporator of the air conditioner, and FIG. 7 is a graph illustrating a diagram of air conditioning cycles according to the present invention.

The air conditioner according to the embodiment of the present invention includes an indoor unit 50 for cooling indoor air by heat exchange with a low temperature and low pressure refrigerant, and an outdoor unit 52 for recovering the heat-exchanged refrigerant to the low temperature and low pressure state.

The above described air conditioner cools indoor air with a first cooling cycle in which the indoor air performs heat exchange with a first refrigerant, and a second cooling cycle in which the cooled indoor air having passed through the first cooling cycle performs heat exchange again with a second refrigerant so as to be re-cooled, thereby having a more lower temperature than that of the indoor air cooled by the first cooling cycle.

The first cooling cycle includes a main compressor 60 for compressing the first refrigerant, a main condenser 62 in which the compressed first refrigerant is condensed, emitting heat, a main expansion valve 64 for expanding the condensed first refrigerant, and a main evaporator 66 in which the first refrigerant evaporates, absorbing heat of the indoor air.

The main compressor 60 may be a single-type or a multi-type compressor. In the case in which the main compressor 60 is the single-type, it also can be an inverter type or a constant speed type. The main evaporator 66 is disposed in the indoor unit 50 so that the first refrigerant can perform heat exchange with the indoor air, and the main compressor 62 is disposed in the outdoor unit 52 so that the first refrigerant does not emit heat to the indoor air because the refrigerant emits heat while it is condensed.

The first refrigerant used in the first cooling cycle is preferably R-22 which has an air conditioning cycle diagram shown in FIG. 7, has a condensation temperature of about 43.9° C. in the main compressor 62 and has an evaporation temperature of about −16.8° C. in the main evaporator 66.

The second cooling cycle includes a fast cooling compressor 70 for compressing fast a second refrigerant, a fast cooling condenser 72 for condensing the compressed second refrigerant, a fast cooling expansion valve 74 for expanding the condensed second refrigerant, and a fast cooling evaporator 76 in which the second refrigerant discharged from the fast cooling expansion valve 74 evaporates, absorbing heat of the indoor air cooled by the main evaporator 66.

Like the main compressor 60, the fast cooling compressor 70 is preferably a single-type or a multi-type compressor. Further, in the case in which the fast-cooling compressor 70 is the single-type, it may be an inverter type or a constant speed type.

The fast cooling condenser 72 is disposed in the indoor unit 50 and is structured such that the second refrigerant in the fast-refrigerant condenser 72 performs heat exchange with the first refrigerant of the main evaporator 66.

Hereinafter, the combination of the fast-cooling condenser 72 and the main evaporator 66, causing heat exchange between the second refrigerant in the fast-cooling condenser 72 and the first refrigerant in the main evaporator 66, is called a midway heat exchanger 80.

The midway heat exchanger 80 is structured as a double pipe including an inner pipe which is a first refrigerant pipe 82 through which the first refrigerant flows and an outer pipe which is a second refrigerant pipe 84 through which the second refrigerant flows.

In the double pipe of the midway heat exchanger 80, the first refrigerant pipe 82 and the second refrigerant pipe 84 are coaxial, and are structured such that the flows of the first and second refrigerants are opposite to each other.

The double pipe of the midway heat exchanger 80 is made of a material having the good heat exchangeability so that heat exchange is easily caused between the first refrigerant and the second refrigerant. The midway heat exchanger 80 preferably further includes a plurality of heat exchange pins 86 at an exterior of the double pipe so that heat exchange is easily caused between ambient air and the first refrigerant in the double pipe.

In the midway heat exchanger 80, the second refrigerant does not directly perform heat exchange with the ambient air since the second refrigerant pipe 84 is disposed inside the first refrigerant pipe 82.

By the way, the second refrigerant passing out the fast cooling condenser 72 is re-condensed by the fast cooling re-condenser 78 after it is expanded by the fast cooling expansion valve 74.

The fast-cooling re-condenser 78 is provided to enable the second refrigerant passing out the fast-cooling condenser 72 to be re-condensed by performing heat exchanged with hot outdoor air.

The fast cooling re-condenser 78 includes a sink refrigerant pipe 78*a* connected to the fast cooling condenser 72 of the midway heat exchanger 80 and the fast cooling expansion valve 74, and through which the second refrigerant passing out the fast cooling condenser 72 of the midway heat exchanger 80 flows, and a sink blower 78*b* for blowing outdoor air to the sink refrigerant pipe 78*a* so that the second refrigerant in the sink refrigerant pipe 78*a* performs heat exchange with the outdoor air, thereby to be re-condensed.

Since the second refrigerant emits heat when it is condensed, the sink refrigerant pipe 78*a* is preferably installed in the outdoor unit 52 so that the second refrigerant in the sink refrigerant pipe 78*a* does not emit heat to the indoor air. The sink refrigerant pipe 78*a* has a plurality of heat exchange pins on the outer surface thereof to facilitate heat exchange between the refrigerant therein and the outdoor air.

The fast cooling evaporator 76 is installed in the indoor unit 50 and disposed right in front of the midway heat exchanger 80 in the direction of the flow of the indoor air so that the indoor air cooled in the main evaporator 66 is re-cooled by performing heat exchange with the second refrigerant of the fast-cooling evaporator 76.

The fast-cooling evaporator 76 disposed right in front of the midway heat exchanger 80 includes a fast cooling refrigerant pipe 76*a* through which the second refrigerant flows, and a plurality of fast-cooling heat exchange pins 76*b* provided on the outer surface of the fast-cooling refrigerant pipe 76*a*. Particularly, the fast cooling heat exchange pins 76*b* can be arranged in the longitudinal direction of the fast-cooling refrigerant pipe 76*a* to reduce pneumatic resistance of the indoor air.

The second refrigerant used in the second cooling cycle is needed to have a condensation temperature at which the refrigerant can be condensed by performing heat exchange with the first refrigerant in the midway heat exchanger 80, and have a lower evaporation heat than that of the first refrigerant of the main evaporator 66. Accordingly, the second refrigerant is preferably R-23. That is, the second refrigerant has the air conditioning diagram shown in FIG. 7, a condensation temperature of about −23.5° C. in the fast-cooling condenser 72 and an evaporation temperature of about −79.7° C. in the fast-cooling evaporator 76.

Further, in the second cooling cycle, the fast cooling compressor 70 and capacity of the fast cooling compressor 70 are controlled such that the indoor air can be cooled even though the first refrigerant in the midway heat exchanger 80 absorbs not only heat of the indoor air but also heat of the second refrigerant.

The air conditioner according to the embodiment of the present invention can further include an indoor blower 90 disposed in the indoor unit 50 for generating a blowing force that blows the indoor air to a room after the indoor air is introduced into the indoor unit 50 and sequentially passes through the midway heat exchanger 80 and the fast-cooling evaporator 76. The air conditioner according to the embodiment of the present invention can still further include an outdoor blower 92 disposed in the outdoor unit 52 for generating a blowing force that blows the outdoor air to the main condenser 62.

The air conditioner may yet further include a controller (not shown) which controls the whole the air conditioner to alternatively operate in a general cooling mode in which the indoor is cooled by the first cooling cycle and in a fast cooling mode in which the indoor air cooled by the first cooling cycle is re-cooled by the second cooling cycle.

The controller controls the air conditioner to operate alternatively in the general cooling mode or in the fast cooling mode, according to the load that is the difference between a current indoor temperature and a target temperature, or to the user's mode selection.

The above described air conditioner operates as follows.

In the general cooling mode, only the first cooling cycle operates but the second cooling cycle keeps stopped.

That is, the first refrigerant is compressed to have a high pressure in the main compressor 60, condensed to have a low temperature by performing heat exchange with the outdoor air blown by the outdoor blower 92 in the main condenser 62, and then expanded thereby to have a low pressure and the low temperature in the main expansion valve 64.

The first refrigerant expanded in the main expansion valve 64 evaporates by performing heat exchange with the indoor air blown by the indoor blower 90, so that the indoor air is cooled by the heat exchange with the first refrigerant in the main evaporator 66 of the midway heat exchanger 80.

In this instance, since the second cooling cycle keeps stopped, there is no heat exchange between the first refrigerant and the second refrigerant in the midway heat exchanger 80. The indoor air cooled by the midway heat exchanger 80 is blown to the fast cooling evaporator 76 by the indoor blower 90, but the air is blown out without heat exchange with the second refrigerant in the fast cooling evaporator 76.

On the other hand, in the fast cooling mode, both of the first and second cooling cycles operate.

That is, the first refrigerant circulates through the main compressor 60, the main condenser 62, the main expansion valve 64 and the main evaporator 66 of the heat exchanger 80 and evaporates in the main evaporator 66 of the midway heat exchanger 80 by performing heat exchange with the indoor air blown by the indoor blower 90. The indoor air is cooled by performing heat exchange with the first refrigerant in the main evaporator 66 of the midway heat exchanger 80.

At the same time, the second refrigerant is compressed to have a high pressure in the fast cooling compressor 70, and the compressed second refrigerant is condensed by performing heat exchange in the fast cooling condenser 72 of the midway heat exchanger 80 with the first refrigerant of the main evaporator of the midway heat exchanger 80.

The second refrigerant condensed in the fast cooling condenser 72 of the midway heat exchanger 80 is re-condensed by heat exchange with the outdoor air blown to the fast cooling re-condenser 78 by the sink blower 78*b* in the fast cooling re-condenser 78, and the re-condensed second refrigerant is expanded in the fast cooling expansion valve 74.

The second refrigerant which is expanded in the fast cooling expansion valve 74 and has a low temperature and a low pressure evaporates by heat exchange with the indoor air, which is cooled in the main evaporator 66 of the midway heat exchanger 80. The indoor air is re-cooled by heat exchange with the second refrigerant in the fast cooling evaporator 76 and then discharged out.

During the fast cooling mode operation, the second refrigerant sequentially circulates through the fast cooling compressor 70, the fast cooling condenser 72, the fast cooling re-condenser 78, and the fast cooling expansion valve 74 and the fast cooling evaporator 76, thereby cooling a room.

The air conditioner according to the embodiment of the present invention has the following advantages:

First, fast and agreeable cooling can be achieved by simultaneously operating the general cooling cycle using the first refrigerant and the fast cooling cycle using second refrigerant, in which the indoor air cooled by the general cooling cycle is re-cooled by the fast cooling cycle.

Second, it is possible to respond to user's demand and indoor load, and enhance energy efficiency by alternatively operating only the first cooling cycle in the general cooling mode or both of the first and second cooling cycles simultaneously in the fast cooling mode.

Third, it is possible to ensure undercooling by adopting the double cooling cycle using R-22 as the first refrigerant and R-23 as the second refrigerant so that the first refrigerant of the main evaporator and the second refrigerant of the fast cooling condenser can perform heat exchange with each other in the fast cooling mode.

What is claimed is:

1. An air conditioner comprising:

a main compressor in which a first refrigerant is compressed;

a main condenser in which the first refrigerant compressed in the main compressor is condensed;

a main expansion valve in which the first refrigerant condensed in the main condenser is expanded;

a main evaporator in which the first refrigerant discharged from the main expansion valve evaporates by performing heat exchange with ambient air, thereby cooling the ambient air; and a fast cooler having a cooling cycle for re-cooling the ambient air cooled once in the main evaporator, using a second refrigerant condensed by heat exchange with the first refrigerant of the main evaporator, wherein the fast cooler includes:

a fast cooling condenser in which the second refrigerant is condensed;

a fast cooling re-condenser in which the second refrigerant condensed in the fast cooling condenser is re-condensed by performing heat exchange with the ambient air;

a fast cooling expansion valve in which the re-condensed second refrigerant is expanded;

a fast cooling evaporator in which the second refrigerant discharged from the fast cooling expansion valve evaporates; and a fast cooling compressor for compressing the second refrigerant vaporized in the fast cooling evaporator, wherein the main evaporator and the fast cooling condenser comprise an intermediate heat exchanger in which the second refrigerant of the fast cooling condenser is condensed by performing heat exchange with the first refrigerant of the main evaporator, wherein the fast cooling evaporator is located in front of the intermediate heat exchanger such that the ambient air is re-cooled by heat exchange with the second refrigerant of the fast cooling evaporator, and wherein the second refrigerant comprises a material having a lower evaporation calorie than the first refrigerant so that the second refrigerant can be condensed by heat exchange with the first refrigerant.

2. The air conditioner according to claim 1, wherein the fast cooling re-condenser comprises a sync refrigerant tube through which the second refrigerant flows, and a sync blower for generating a blowing force such that the second refrigerant in the sync refrigerant tube is condensed by heat exchange with the ambient air.

3. The air conditioner according to claim 2, further comprising an indoor blower for generating a blowing force that enables air cooled in the main evaporator sequentially to pass through the fast cooling evaporator, thereby performing heat exchange.

4. The air conditioner according to claim 1, further comprising an indoor blower for generating a blowing force that enables air cooled in the main evaporator to sequentially pass through the fast cooling evaporator, thereby performing heat exchange.

5. An air conditioner, comprising:

an outdoor unit, comprising:

a main compressor, a main condenser and a main expander that sequentially compress, condense and expand a first refrigerant;

a fast cooling compressor that compresses a second refrigerant;

a fast cooling recondenser; and a fast cooling expander;

an indoor unit, comprising:

an intermediate heat exchanger comprising a main evaporator that cools ambient air and evaporates the expanded first refrigerant, and a fast cooling condenser that condenses the compressed second refrigerant; the intermediate heat exchanger having a dual tube structure in which the first refrigerant flows through a first refrigerant tube in a first direction, the second refrigerant flows through a second refrigerant tube in a direction opposite to the first direction, and the second refrigerant tube is provided within the first refrigerant tube;

a fast cooling evaporator that re-cools the ambient air;

an air blower that sucks in the ambient air, and blows the ambient air across the intermediate heat exchanger and the fast cooling evaporator; and a control unit, wherein the fast cooling recondenser recondenses the second refrigerant condensed by the fast cooling condenser, the fast cooling expander expands the recondensed second refrigerant, the fast cooling evaporator evaporates the expanded second refrigerant, and the control unit controls a first cooling cycle, comprising the main compressor, the main condenser, the main expander and the main evaporator, to operate in a general cooling mode, and the control unit further controls a second cycle, comprising the fast cooling compressor, fast cooling condenser, the fast cooling recondenser, the fast cooling expander, and the fast cooling evaporator, to operate in a fast cooling mode, wherein the second refrigerant comprises a material having a lower evaporation calorie than the first refrigerant so that the second refrigerant can be condensed by heat exchange with the first refrigerant.

6. The air conditioner according to claim 5, wherein the fast cooling recondenser consists of a sync refrigerant tube through which the second refrigerant flows and a sync air blower which blows air to allow the second refrigerant to be condensed in the sync refrigerant tube by heat exchange with ambient air.

7. The air conditioner according to claim 5, wherein the fast cooling evaporator consists of a fast cooling evaporator refrigerant tube and a plurality of fast cooling evaporator pins inserted into an outside of the fast cooling evaporator refrigerant tube.

* * * * *